United States Patent [19]

Decker et al.

[11] 4,252,528

[45] Feb. 24, 1981

[54] LUBRICANT COMPOSITIONS FOR FINISHING SYNTHETIC FIBERS

[75] Inventors: Quintin W. Decker, St. Albans; Erich Marcus; Harvey S. Koenig, both of Charleston, all of W. Va.

[73] Assignee: Union Carbide Corporation, New York, N.Y.

[21] Appl. No.: 25,663

[22] Filed: Mar. 30, 1979

[51] Int. Cl.[3] ..... D06M 13/10; D06M 13/16; D06M 13/18; D06M 15/10

[52] U.S. Cl. ..... 8/115.6; 252/8.9

[58] Field of Search ..... 252/8.9; 8/115.6

[56] References Cited

U.S. PATENT DOCUMENTS

| | | | |
|---|---|---|---|
| 2,677,700 | 5/1954 | Jackson et al. | 260/488 |
| 2,768,141 | 10/1956 | Langer et al. | 252/73 |
| 2,915,559 | 12/1959 | Horsley et al. | 260/613 |
| 3,306,850 | 2/1967 | Olsen | 252/8.7 |
| 3,338,830 | 8/1967 | Stokes et al. | 252/8.9 |
| 3,341,452 | 9/1967 | Cooley | 252/8.9 |
| 3,421,935 | 1/1969 | Finch | 117/138.8 |
| 3,704,225 | 11/1972 | Shay | 252/8.9 |
| 3,926,816 | 12/1975 | Cohen et al. | 252/8.9 |
| 3,963,628 | 6/1976 | Park | 252/8.9 |
| 4,019,990 | 4/1977 | Marshall et al. | 252/8.9 |
| 4,069,160 | 1/1978 | Hawkins | 252/8.9 |
| 4,134,841 | 1/1979 | Park | 252/8.9 |
| 4,137,181 | 1/1979 | Hawkins | 252/8.9 |
| 4,169,062 | 9/1979 | Weipert | 252/8.9 |

*Primary Examiner*—Joseph L. Schofer
*Assistant Examiner*—Herbert J. Lilling
*Attorney, Agent, or Firm*—Franklyn Schoenberg

[57] ABSTRACT

A spin finish for synthetic fibers has been developed consisting essentially of a thermally stable lubricant and a surfactant derived from an ethylene oxide/propylene oxide block co-polymer adduct of an alkylated phenol.

19 Claims, No Drawings

LUBRICANT COMPOSITIONS FOR FINISHING SYNTHETIC FIBERS

BACKGROUND OF THE INVENTION

This invention pertains to lubricant compositions for finishing synthetic fibers and more particularly to such compositions containing propylene oxide/ethylene oxide block co-polymer adducts of alkylated phenols as emulsifiers.

During the conventional manufacture of synthetic continuous filament yarn, such as polyamides and polyesters, the yarn is treated with a lubricating composition usually in the form of an aqueous emulsion. Such compositions normally contain a lubricant, such as, fatty acid esters, hydrocarbon oils, and/or vegetable oils, an anti-static agent, an anti-oxidant and an emulsifier system to render the lubricant composition water emulsifiable. The complete lubricant composition should serve the processing and manufacturing needs of the fiber producer as well as the user of the synthetic yarn. The lubricant composition provides controlled lubricity (frictional properties) during yarn processing by high-speed machinery, provides proper yarn intra-frictional properties, and protects the yarn from damage during manufacturing and processing handling requirements.

For high speed and high-temperature yarn processing, such as, hot-stretching, bulking, crimping and texturizing, the lubricant composition must function adequately at both ambient and high temperatures. In addition to the aforementioned requirements, the lubricating composition must exhibit special qualities for high-temperature processing, that is, the composition should be sufficiently stable so as not to smoke or fume nor result in the formation of varnishes or resins upon deposition onto machinery-heated surfaces. In order to meet the thermal requirements, each component of lubricating composition should posses the necessary thermal stability. However, in actual practice only some of the components fulfill the thermal prerequisites. In particular, some emulsifier systems fail to meet the thermal stability standards because of the chemical make-up of the emulsifier or emulsifiers which is designed to produce stable aqueous emulsions of lubricant composition. High fuming or smoking and/or varnish formation upon exposure to high temperatures also are normally encountered with conventional surfactants used to formulate the emulsification systems. In addition, the necessity of employing more than one surfactant to achieve stable aqueous emulsions complicates the situation.

Commonly used surfactants such as alkylphenol ethoxylates, sorbitan ethoxylate esters, (hydrolyzed) vegetable oil ethoxylates, alkyl alcohol ethoxylates, fatty acid ethoxylates, and the like, do not meet all the requirements of an emulsifier in a lubricant composition for synthetic yarn. For example, the sorbitan ethoxylate esters and the (hydrolyzed) vegetable oil ethoxylates, although good emulsifiers, produce high amounts of thermo-oxidation varnishes and are high viscosity components, a factor which is undesirable due to the direct relationship between viscosity and friction. The alkyl alcohol ethoxylates produce large amounts of smoke and require complicated combinations of surfactants to yield stable lubricant composition emulsions. The alkylphenol ethoxylates are good low-fuming emulsifiers, but create unacceptable varnishes. Compared to the other nonionic surfactants listed above, the alkylphenol ethoxylates display the best overall properties as lubricant components for synthetic yarn. However, their versatility as emulsifiers is limited due to the fact that a single surfactant fails to emulsify a variety of commonly used lubricants.

It is therefor an object of this invention to provide synthetic yarn lubricant compositions containing emulsifiers which display the proper thermal stability low fuming characteristics and emulsification versatility. It is a further object of this invention to provide a single surfactant having acceptable high temperature stability and resistance to varnish formation upon exposure to heated surfaces and which will emulsify conventional lubricants used in high-temperature processing of synthetic fibers.

A still further object of this invention is to provide surfactants which produce microemulsions with conventional high-temperature process lubricants.

An indication of the fuming tendencies of a substance is obtained by the measurement of the smoke point.

SUMMARY OF THE INVENTION

The objects of this invention have been satisfied by a spin finish for synthetic fibers consisting essentially of:

(A) About 60–90% by weight of a thermally stable lubricant selected from the group consisting of:

(1) esters of fatty acids having 12 to 18 carbons and saturated aliphatic alcohols having about 8 to 18 carbons;

(2) triglycerides of fatty acids having 12 to 18 carbon atoms; and (3) esters of a polyhydric alcohol and an alkanoic acid having about 8 to 12 carbon atoms where the polyhydric alcohol has the formula:

$$(R)_y C\text{-}(CH_2OH)_x$$

wherein x is an integer having values of 3 or 4, R is alkyl having 1 to 3 carbons, y is an integer having values of 0 or 1 with the proviso that when x=4, y=0; and (4) esters of dibasic fatty acids having 2 to 18 carbons and saturated aliphatic alcohols having about 4 to 18 carbons;

(B) About 10–40% by weight of a surfactant having the formula

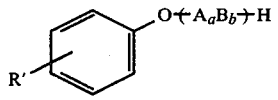

wherein:

R' is an alkyl having 6 to 14 carbons,

A is $$-CH_2-\overset{\overset{\displaystyle CH_3}{|}}{C}HO-,$$

B is $-CH_2CH_2O-$, a is an integer having values of about 4 to 20, preferably 6 to 16 and b is an integer having values of 3 to 14, preferably 4 to 12.

The lubricants used in this invention are all commercially available. The esters of fatty acids are exemplified by such esters as tridecyl stearate, hexadecyl stearate, dodecyl oleate, octyl linoleate, and the like.

Representative triglycerides include natural triglycerides, such as coconut oil, tallow oil, palm kernel oil, castor oil, and the like.

Preferred esters of a polyhydric alcohol and an alkanoic acid include trimethylolpropane tripelargonate, trimethylolethane, trioctanote, pentaerythritol tetrapelargonate, and the like.

The surfactants of this invention can be made by the reaction of propylene oxide and ethylene oxide with known alkylphenols. In a preferred embodiment commercial nonylphenol is converted to an alkoxide with potassium hydroxide followed by the addition first of propylene oxide to prepare a block of propoxy repeating units at a temperature of about 100° to 150° C. and a pressure of about 1 to about 100 psig followed by the addition of ethylene oxide to incorporate ethoxy blocks at a temperature of about 100° to 150° C. at a pressure of about 20 to 100 psig. The molecular weight of the resultant block co-polymer is about 600 to 2,000 preferably 750 to 1,700 since emulsion stability falls off above molecular weights of about 1,700. Although the moles of ethylene oxide per mole of alkyl phenol can vary from 3 to about 14, it is preferred to use about 4 to about 12 moles. The criticality of the structure of the surfactant was demonstrated as its molecular weight approached 1,700 by the fact that adverse effects are obtained with 15 moles of ethylene oxide per 6 moles of propylene oxide per mole of alkylphenol. A noticeable decrease in emulsion stability for coconut oil lubricant along with a loss in non-smoking properties was demonstrated. It is preferred that the ratio of ethylene oxide to propylene oxide in the surfactant should not be greater than 2 or less than 0.25.

Preferred surfactants are liquids at ambient temperatures having a melting point of about 20° C. or less and viscosities at 25° C. of 350 centipoise or less.

Although the range of lubricant in the spin finish can be about 50 to 90 weight % of the total, it is preferred to use a range of about 60 to 80%. Correspondingly while the surfactant can range between 10 and 50% of the total finish it is preferred to use 20 to 40%. Stated another way the mole ratio of lubricant to surfactant can vary from about 9 to 1 to about 1 to 1.

For practical application of the spin finish to synthetic fibers they are used as aqueous solutions containing about 10 to about 20% of the spin finish emulsified in water.

A preferred surfactant according to this invention can be characterized as having the following properties:

1. A smoke point greater than about 190° C.
2. A volatility at 200° C. of less than 12% per hour during a 5-hour test and a residue from the test which is a liquid.
3. A thin-film residue at 220° C. of less than 5% remaining after 24 hours which is a hot soapy water removable stain.
4. A viscosity of less than 500 centistokes, preferably less than 350 centistokes at 25° C.
5. A melting point of less than 25° C.
6. A cloud point of a 1% aqueous solution greater than 0° C. but less than 50° C.
7. An emulsification effectiveness, when mixed with appropriate lubricants, as measured by the presence of a stable emulsion at 25° C. lasting for at least 24 hours.

The invention is further defined in the examples which follow. All parts and percentages are by weight unless otherwise specified.

EXAMPLE 1

Preparation of Nonylphenol 6 PO (Propylene Oxide)/8 EO (Ethylene Oxide) Block Polymer

Preparation of Starter Alkoxide

In a typical experiment, 330 g. (1.5 moles) of nonylphenol was charged to a 2-liter, 4-necked, round-bottom flask equipped with a stirrer, thermowell, nitrogen purge, and heating mantle. The alcohol was heated to 40° C. with stirring, and the system was nitrogen-purged for 15 minutes. Flake 85 percent potassium hydroxide 3.1 g. (0.2 percent based on total charge) was added and the mixture was heated to 100° C. until the KOH dissolved. In order to remove the water from the reaction, a reflux still head was added to the apparatus and the pressure was reduced to 10 mm Hg. After the water was removed at 100° C. over a one-hour period, the product was cooled and, while maintaining a nitrogen purge on the reactor, a sample, 15 g., was removed for water analysis. Water was determined using the potentiometric Karl Fischer method. A value of 0.014 percent was obtained.

Addition of Propylene Oxide (PO)

The starter alkoxide was charged to a 1.5 gal. stirred stainless steel reactor in a nitrogen atmosphere. After closing the system, 5 psig of nitrogen was put on the reactor and the contents heated to 100° C. The pressure was then adjusted to 10 psig and propylene oxide, which was previously added to the weighed feed tank, was fed to the reactor using a Lapp pump. This pump was designed to recycle liquid back into the pump feed line if the reactor did not need oxide for any reason. Propylene oxide, 522 g., was fed at 110° C. and the pressure was allowed to increase to 60 psig with manual control of the system. Once the reaction lined out at these conditions, the system was placed on automatic control with pressure controlling oxide feed. After the PO addition was complete—after about 4 hours—the system was "cooked out" at 110° C. for 3 additional hours or to a reduced constant pressure to insure complete PO reaction and cooled.

Addition of Ethylene Oxide (EO)

After standing overnight, the reactor was pressurized with nitrogen to 15 psig and heated to 110° C. The pressure was adjust to 20 psig and ethylene oxide, taken from the weighed feed tank, was fed carefully to the system. EO was fed at 110° C. and 60 psig to the reactor until the product had a cloud point of 28° C. The ethylene oxide was cooked out for 2 hours after addition was complete, and the product was cooled and discharged from the reactor in a nitrogen atmosphere to a container containing glacial acetic acid. One ml of glacial acetic acid is used for every gram of potassium hydroxide initially added.

Product Work-Up

The alkoxylated product was neutralized in the laboratory in the same apparatus used to prepare the starter alcohol with additional glacial acetic acid under a nitrogen atmosphere to a pH of 6.8 to 6.5; pH paper in the range of 6 to 8 was used for the measurement. The product was then stripped at 100° C. and a pressure of one mm Hg for one hour to remove any unreacted oxides. Normally, less than 0.5 weight percent was removed. Clear, colorless product was obtained as kettle residue, molecular weight—911, and was evaluated at a high—temperature surfactant and in heat-stable finishes for texturizing polyester yarn.

Evaluation of the Product

The following tests were run on the nonylphenol alkoxylate to demonstrate satisfactory heat-stable properties:

| | |
|---|---|
| Smoke point | 193° C. |
| Volatility | 4.6 percent per hour leaving a brown liquid residue |
| Thin-film residue on stainless steel | 0.9 percent residue which was a yellow varnish, hot soapy water removable |

Other physical properties were:

| | |
|---|---|
| Viscosity | 289 cks (centistokes) at 25° C. |
| Viscosity | 138 cks at 100° F. |
| Specific Gravity | 1.026 at 25° C. |
| Melting Point | 9° C. |
| Cloud Point | 28° C. |

Viscosity was determined with a Cannon-Fenske viscometer. Smoke point was determined by placing 30 ml. of product in a 50 ml. glass beaker and heating the beaker on a hot plate at a rate of 15° C./min. using a thermometer immersed in the product and a black background, the smoke point is recorded at the temperature when the first smoke becomes visible. Volatility tests were carried out in a forced-air oven at 200° C. for 5 hours using a 10 g. sample in a Pyrex dish having an area of 20 $cm^2$.

Residue tests were carried out on a hot plate at 220° C. for 24 hours using an 0.2 g. sample on a 347 stainless steel disc having an area of 12.5 $cm^2$.

Twenty-four (24) Hour Emulsion Stability of textile finishes prepared using the nonylphenol 6 PO/8 EO product is shown in Table 1 at 25° C. These emulsion stabilities are superior to the performance of prior art surfactants as discussed below but the nonylphenol 6 PO/EO block polymers do not exhibit the optimum performances displayed by the nonylphenol 8 PO/EO, 10.5 PO/EO or 12.5 PO/EO block polymer products of Examples 3–11.

TABLE 1

EMULSION STABILITY DATA

| | Wt./Wt. | aqueous emulsion[a] 10% | 15% | 20% |
|---|---|---|---|---|
| Lubricant - Coconut Oil | 80/20 | Stable[b] | Stable | Stable |
| Surfactant - NP 6PO/8EO Ratio | 70/30 | Stable | Stable | Stable |
| | 60/40 | Stable | Stable | Unstable |
| | Wt./Wt. | aqueous emulsion[a] 10% | 15% | 20% |
| Lubricant - Trimethylolpropane Trispelargonate | 80/20 | Stable | Stable | Stable |
| Surfactant - NP 6PO/8EO Ratio | 70/30 | Stable | Stable | Stable |
| | 60/40 | Stable | Stable | Unstable |
| | Wt./Wt. | aqueous emulsion[a] 10% | 15% | 20% |
| Lubricant - Tridecyl Stearate | 80/20 | Unstable | Unstable | Unstable |
| Surfactant - NP 6PO/8EO Ratio | 70/30 | Unstable | Unstable | Unstable |
| | 60/40 | Stable | Unstable | Unstable |

[a]Concentration of the textile finish (lubricant/surfactant mixture) in water. Emulsion prepared at 25° C. (Vol./Vol.)
[b]Stable - emulsion stable for 24 hours or longer Micro - stable micro-emulsion formed

EXAMPLE 2

Preparation of Nonylphenol 6 PO/11 EO Block Polymer

Nonylphenol (884 g., 4.0 moles) was mixed with potassium hydroxide (7.0 g.) as described in Example 1. After water removal, propylene oxide (1,399 g.) was added to the reactor. After the reaction period was complete, ethylene oxide was added to the system as described in Example 1 to a cloud point of 51° C. Product work-up gave a colorless liquid, molecular weight—1069, having excellent heat-stability and emulsification properties.

Evaluation of the Product

The following tests were run on the product to demonstrate satisfactory heat-stable properties:

| | |
|---|---|
| Smoke point | 200° C. |
| Volatility | 5.8 percent per hour leaving an amber liquid residue |
| Thin-film residue on stainless steel | 0.5 percent residue which was a yellow-stain, hot soapy water nonremovable |

Other physical properties were:

| | |
|---|---|
| Viscosity | 304 cks (centistokes) at 25° C. |
| Viscosity | 151 cks at 100° F. |
| Specific Gravity | 1.039 at 25° C. |
| Melting Point | 8° C. |
| Cloud Point | 51° C. |

The following tests were carried out to show emulsion effectiveness:

| | |
|---|---|
| 24-Hour Emulsion Stability | is shown in the following table at 25° C. |

TABLE 2

EMULSION STABILITY DATA

| | Wt./Wt. | aqueous emulsion[a] 10% | 15% | 20% |
|---|---|---|---|---|
| Lubricant-Coconut Oil | 80/20 | Stable[b] | Stable | Unstable |
| Surfactant-NP 6PO/11EO Ratio | 70/30 | Stable | Unstable | Unstable |
| | 60/40 | Stable | Stable | Stable |
| | Wt./Wt. | aqueous emulsion[a] 10% | 15% | 20% |
| Lubricant-Trimethylolpropane Trispelargonate | 80/20 | Stable | Stable | Stable |
| Surfactant-NP 6PO/11EO | 70/30 | Stable | Stable | Unstable |

TABLE 2-continued

| EMULSION STABILITY DATA | | | | |
|---|---|---|---|---|
| Ratio | 60/40 | Stable | Stable | Un-stable |
| | | aqueous emulsion[a] | | |
| | Wt./Wt. | 10% | 15% | 20% |
| Lubricant-Tridecyl Stearate Surfactant-NP 6PO/11EO Ratio | 80/20 | Un-stable | Un-stable | Un-stable |
| | 70/30 | Un-stable | Un-stable | Un-stable |
| | 60/40 | Un-stable | Un-stable | Un-stable |

[a]Concentration of the textile finish (lubricant/surfactant mixture) in water. Emulsion prepared at 25° C. (Vol./Vol.)
[b]Stable - emulsion stable for 24 hours or longer Micro - stable micro-emulsion formed

CONTROL A

Preparations of Nonylphenol 6 PO/15 EO Block Polymer

Nonylphenol (884 g., 4.0 moles) was mixed with potassium hydroxide (7.0 g.) as described in Example 1. After water removal, propylene oxide (1,399 g.) was added to the reactor. After the reaction period was complete, ethylene oxide was added to the system. At this point approximately 1,000 g. of reaction product was withdrawn from the reactor (see Example 2). The system them was closed and additional ethylene oxide was added to give product having a cloud point of 68° C. Product work-up gave a white semi-solid, molecular weight—1229, having marginal heat-stability and emulsification properties.

Evaluation of the Product

The following tests were run on the product to demonstrate satisfactory heat-stable properties:

| | |
|---|---|
| Smoke point | 190° C. |
| Volatility | 8.7 percent per hour leaving an amber liquid residue |
| Thin-film residue on aluminum | 1.0 percent residue which was an amber varnish, hot soapy water nonremovable. |

Other physical properties were:

| | |
|---|---|
| Viscosity | 333 cks (centistokes) at 25° C. |
| Viscosity | 170 cks at 100° F. |
| Specific Gravity | 1.047 at 25° C. |
| Melting Point | 18° C. |
| Cloud Point | 68° C. |

The following tests were carried out to show emulsion effectiveness:

| | |
|---|---|
| 24-Hour Emulsion Stability | is shown in the following table at 25° C. |

TABLE 3

| EMULSION STABILITY DATA | | | | |
|---|---|---|---|---|
| | Wt./Wt. | 10% | 15% | 20% |
| Lubricant - Coconut Oil Surfactant - NP 6PO/15EO Ratio | 80/20 | Unstable[b] | Unstable | Unstable |
| | 70/30 | Unstable | Unstable | Unstable |
| | 60/40 | Stable | Stable | Unstable |
| | | aqueous emulsion[a] | | |
| | Wt./Wt. | 10% | 15% | 20% |
| Lubricant - Trimethylolpropane Trispelargonate Surfactant - NP 6PO/15EO Ratio | 80/20 | Stable | Stable | Stable |
| | 70/30 | Stable | Stable | Stable |
| | 60/40 | Stable | Stable | Unstable |
| | | aqueous emulsion[a] | | |
| | Wt./Wt. | 10% | 15% | 20% |
| Lubricant - Tridecyl Stearate Surfactant - NP 6PO/15EO Ratio | 80/20 | Unstable | Unstable | Unstable |
| | 70/30 | Unstable | Unstable | Unstable |
| | 60/40 | Unstable | Unstable | Unstable |

[a]Concentration of the textile finish (lubricant/surfactant mixture) in water. Emulsion prepared at 25° C. (Vol./Vol.)
[b]Stable - emulsion stable for 24 hours or longer Micro - stable micro-emulsion formed

EXAMPLE 3

Preparation of Nonylphenol 8 PO/6.5 EO Block Polymer

Nonylphenol (220 lb., 1.0 lb. mole) was mixed with potassium hydroxide (2.2 lbs.) in a 100-gal. stirred reactor. A procedure was used which is similar to that described in Example 1. After water removal, propylene oxide (464 lbs.) was added to the reactor. After the reaction period was complete, ethylene oxide was added to the system as described in Example 1 to a cloud point of 23° C. Product work-up gave a colorless liquid, molecular weight—971, having excellent heatstability and emulsification properties.

Evaluation of the Product

The following tests were run on the product to demonstrate satisfactory heat-stable properties:

| | |
|---|---|
| Smoke point | 201° C. |
| Volatility | 2.4 percent per hour leaving a liquid residue varnish |
| Thin-film residue on stainless steel | 1.1 percent residue which was an yellow varnish, hot soapy water removable |

Other physical Properties were:

| | |
|---|---|
| Viscosity | 322 cks (centistokes) at 25° C. |
| Viscosity | 150 cks at 100° F. |
| Specific Gravity | 1.023 at 25° C. |
| Melting Point | 7° C. |
| Cloud Point | 22° C. |

The product was used to prepare textile finishes with different lubricants. The excellent heatstability of these finishes can be seen in Table 4.

TABLE 4

| HEAT STABILITY DATA |
|---|
| 200° C. Volatility Test |

TABLE 4-continued

HEAT STABILITY DATA

| | Wt./Wt. | Percent per Hour CO | TMP | TDS[a] |
|---|---|---|---|---|
| Lubricant/ Surfactant Ratio | 100/0 | 0.7 | 2.4 | 2.8 |
| | 80/20 | 1.7 | 2.7 | 4.7 |
| | 70/30 | 2.0 | 2.3 | 4.2 |
| | 60/40 | 2.4 | 2.8 | 5.0 |

As reference: Neat Surfactant - 2.4

| | Wt./Wt. | 220° C. Residue Test Percent Residue CO | TMP | TDS |
|---|---|---|---|---|
| Lubricant/ Surfactant Ratio | 100/0 | 32.5 | 12.0 | 4.0 |
| | 80/20 | 41.4[b] | 7.5 | — |
| | 70/30 | 39.7[b] | 6.3 | — |
| | 60/40 | 33.3[b] | 8.3 | 3.6 |

As reference: Neat Surfactant - 1.1

[a]Lubricants: CO - coconut oil; TMP - trimethylolpropane trispelargonate; TDS - tridecyl stearate

[b]Liquid residue was obtained

Tests were carried out to show emulsion stability on textile finishes prepared from the nonylphenyl 8 PO/6.5 EO product are presented in Tables 5 and 6.

TABLE 5

EMULSION STABILITY DATA

| | Wt./Wt. | aqueous emulsion[a] 10% | 15% | 20% |
|---|---|---|---|---|
| Lubricant - Coconut Oil Surfactant - NP 8PO/6.5EO Ratio | 80/20 | Stable[b] | Stable | Stable |
| | 70/30 | Stable | Stable | Stable |
| | 60/40 | Stable | Stable | Stable |
| | Wt./Wt. | aqueous emulsion[a] 10% | 15% | 20% |
| Lubricant - Trimethylol-propane Trispelargonate Surfactant - NP 8PO/6.5EO Ratio | 80/20 | Stable | Stable | Stable |
| | 70/30 | Stable | Stable | Stable |
| | 60/40 | Stable | Stable | Stable |
| | Wt./Wt. | aqueous emulsion[a] 10% | 15% | 20% |
| Lubricant - Tridecyl Stearate Surfactant - NP 8PO/6.5EO Ratio | 80/20 | Stable | Stable | Stable |
| | 70/30 | Stable | Stable | Stable |
| | 60/40 | Stable | Stable | Stable |

[a]Concentration of the textile finish (lubricant/surfactant mixture) in water. Emulsion prepared at 25° C. (Vol./Vol.)

[b]Stable - emulsion stable for 24 hours or longer Micro - stable micro-emulsion formed

TABLE 6

EMULSION STABILITY DATA

| | Wt./Wt. | aqueous emulsion[a] 10% | 15% | 20% |
|---|---|---|---|---|
| Lubricant - Coconut Oil Surfactant - NP 8PO/6.5EO Ratio | 80/20 | Stable[b] | Stable | Stable |
| | 70/30 | Stable | Stable | Stable |
| | 60/40 | Micro | Micro | Micro |
| | Wt./Wt. | aqueous emulsion[a] 10% | 15% | 20% |
| Lubricant - Trimethylol-propane Trispelargonate Surfactant - NP 8PO/6.5EO Ratio | 80/20 | Stable | Stable | Stable |
| | 70/30 | Stable | Stable | Stable |
| | 60/40 | Micro | Micro | Micro |
| | Wt./Wt. | aqueous emulsion[a] 10% | 15% | 20% |
| Lubricant - Tridecyl Stearate Surfactant - NP 8PO/6.5EO | 80/20 | Stable | Stable | Stable |
| | 70/30 | Stable | Stable | Stable |
| | 60/40 | Micro | Micro | Micro |

TABLE 6-continued

EMULSION STABILITY DATA

Ratio

[a]Concentration of the textile finish (lubricant/surfactant mixture) in water. Emulsion prepared at 70° C. (Vol./Vol.)

[b]Stable - emulsion stable for 24 hours or longer Micro - stable micro-emulsion formed

EXAMPLE 4

Preparation on Nonylphenol 8 PO/7.5 EO Block Polymer

Nonylphenol (220 lbs., 1.0 lb. moles) was mixed with potassium hydroxide (2.2 lbs.) as described in Example 3. After water removal, propylene oxide (464 lbs.) was added to the reactor. After the reaction period was complete, ethylene oxide was added to the system as described in Example 3. At this point approximately 350 lbs. of reaction product was withdrawn from the reactor (see Example 3). The system then was closed and additional ethylene oxide was added to give a product having a cloud point of 26° C. Product work-up gave a colorless liquid, molecular weight—1012, having excellent heat-stability and emulsification properties.

Evaluation of the Product

The following tests were run on the product to demonstrate satisfactory heat-stable properties:

| | |
|---|---|
| Smoke point | 205° C. |
| Volatility | 2.3 percent per hour leaving a liquid residue varnish |
| Thin-film residue on stainless steel | 1.5 percent residue which was a yellow varnish, hot soapy water removable |

Other physical properties were:

| | |
|---|---|
| Viscosity | 324 cks (centistokes) at 25° C. |
| Viscosity | 157 cks at 100° F. |
| Specific Gravity | 1.026 at 25° C. |
| Melting Point | 5° C. |
| Cloud Point | 26° C. |

The product was used to prepare textile finishes with different lubricants. The excellent heat-stability of these finishes can be seen in Table 7.

TABLE 7

HEAT STABILITY DATA

| | Wt./Wt. | 200° C. Volatility Test Percent per Hour CO | TMP | TDS[a] |
|---|---|---|---|---|
| Lubricant/ Surfactant Ratio | 100/0 | 0.7 | 2.4 | 2.8 |
| | 80/20 | 1.4 | 2.7 | 3.9 |
| | 70/30 | 1.7 | 2.3 | 4.0 |
| | 60/40 | 1.9 | 2.9 | 4.0 |

As reference: Neat Surfactant - 2.3

| | Wt./Wt. | 220° C. Residue Test Percent Residue CO | TMP | TDS |
|---|---|---|---|---|
| Lubricant/ Surfactant Ratio | 100/0 | 32.5 | 12.0 | 4.0 |
| | 80/20 | 43.3[b] | 7.9 | — |
| | 70/30 | 40.5[b] | 8.0 | — |

TABLE 7-continued

| HEAT STABILITY DATA | | | |
|---|---|---|---|
| 60/40 | 33.1[b] | 7.8 | 3.5 |

As reference: Neat Surfactant - 1.5
[a]Lubricants: CO - coconut oil; TMP - Trimethylolpropane trispelargonate; TDS - tridecyl stearate
[b]Liquid residue was obtained.

The following tests were carried out to show emulsion stability of textile finishes prepared from the nonylphenol 8 PO/7.5 EO product.

TABLE 8

| EMULSION STABILITY DATA | | | | |
|---|---|---|---|---|
| | | aqueous emulsion[a] | | |
| | Wt./Wt. | 10% | 15% | 20% |
| Lubricant - Coconut Oil | 80/20 | Stable[b] | Stable | Stable |
| Surfactant - NP 8PO/7.5EO | 70/30 | Stable | Stable | Stable |
| Ratio | 60/40 | Stable | Stable | Stable |
| | | aqueous emulsion[a] | | |
| | Wt./Wt. | 10% | 15% | 20% |
| Lubricant - Trimethylol- | 80/20 | Stable | Stable | Stable |
| propane Trispelargonate | 70/30 | Stable | Stable | Stable |
| Surfactant - NP 8PO/7.5EO | 60/40 | Stable | Stable | Stable |
| Ratio | | | | |
| | | aqueous emulsion[a] | | |
| | Wt./Wt. | 10% | 15% | 20% |
| Lubricant - Tridecyl | 80/20 | Stable | Stable | Stable |
| Stearate | 70/30 | Stable | Stable | Stable |
| Surfactant - NP 8PO/7.5EO | 60/40 | Stable | Stable | Stable |
| Ratio | | | | |

[a]Concentration of the textile finish (lubricant/surfactant mixture) in water. Emulsion prepared at 25° C. (Vol./Vol.)
[b]Stable - emulsion stable for 24 hours or longer Micro - stable micro-emulsion formed

| | | aqueous emulsion[a] | | |
|---|---|---|---|---|
| | Wt./Wt. | 10% | 15% | 20% |
| Lubricant - Coconut Oil | 80/20 | Stable[b] | Stable | Stable |
| Surfactant - NP 8PO/7.5EO | 70/30 | Stable | Stable | Stable |
| Ratio | 60/40 | Micro | Micro | Micro |
| | | aqueous emulsion[a] | | |
| | Wt./Wt. | 10% | 15% | 20% |
| Lubricant - Trimethylol- | 80/20 | Stable | Stable | Stable |
| propane Trispelargonate | 70/30 | Stable | Stable | Stable |
| Surfactant - NP 8PO/7.5EO | 60/40 | Micro | Micro | Micro |
| Ratio | | | | |
| | | aqueous emulsion[a] | | |
| | Wt./Wt. | 10% | 15% | 20% |
| Lubricant - Tridecyl | 80/20 | Stable | Stable | Stable |
| Stearate | 70/30 | Stable | Stable | Stable |
| Surfactant - NP 8PO/7.5EO | 60/40 | Micro | Micro | Micro |
| Ratio | | | | |

[a]Concentration of the textile finish (lubricant/surfactant mixture) in water. Emulsion prepared at 70° C. (Vol./Vol.)
[b]Stable - emulsion stable for 24 hours or longer Micro - stable micro-emulsion formed

EXAMPLE 5

Preparation of Nonylphenol 8 PO/8.0 EO Block Polymer

Nonylphenol (220 lbs., 1.0 lb. moles) was mixed with potassium hydroxide (2.2 lbs.) as described in Example 3. After water removal, propylene oxide (464 lbs.) was added to the reactor. After the reaction period was complete, ethylene oxide was added to the system as described in Example 3 and 4. At this point an additional 350 lbs. of reaction product was withdrawn from the reactor (see Example 4). The system then was closed and additional ethylene oxide was added to give a product having a cloud point of 30° C. Product work-up gave a colorless liquid, molecular weight—1036, having excellent heat-stability and emulsification properties.

Evaluation of the Product

The following tests were run on the product to demonstrate satisfactory heat-stable properties:

| | |
|---|---|
| Smoke point | - 222° C. |
| Volatility | - 1.4 percent per hour leaving a liquid residue varnish |
| Thin-film residue on stainless steel | - 1.2 percent residue which was an yellow varnish, hot soap water removable |

Other physical properties were:

| | |
|---|---|
| Viscosity | - 346 cks (centistokes) at 25° C. |
| Viscosity | - 160 cks at 100° F. |
| Specific Gravity | - 1.029 at 25° C. |
| Melting Point | - 7° C. |
| Cloud Point | - 30° C. |

The product was used to prepare textile finishes with different lubricants. The excellent heat-stability of these finishes can be seen in Table 9.

TABLE 9

| HEAT STABILITY DATA | | | | |
|---|---|---|---|---|
| | | 200° C. Volatility Test Percent per Hour | | |
| | Wt./Wt. | CO | TMP | TDS[a] |
| Lubricant/ | 100/0 | 0.7 | 2.4 | 2.8 |
| Surfactant Ratio | 80/20 | 1.4 | 2.4 | 4.2 |
| | 70/30 | 1.8 | 2.0 | 3.9 |
| | 60/40 | 1.8 | 2.9 | 4.3 |

As reference: Neat Surfactant - 1.4

| | | 220° C. Residue Test Percent Residue | | |
|---|---|---|---|---|
| | Wt./Wt. | CO | TMP | TDS |
| Lubricant/ | 100/0 | 32.5 | 12.0 | 4.0 |
| Surfactant Ratio | 80/20 | 42.1[b] | 8.3 | — |
| | 70/30 | 41.6[b] | 7.6 | — |
| | 60/40 | 30.6[b] | 8.4 | 3.1 |

As reference: Neat Surfactant - 1.2
[a]Lubricants: CO - coconut oil; TMP -trimethylolpropane trispelargonate; TDS - tridecyl stearate
[b]Liquid residue was obtained.

The following tests were carried out to show emulsion stability of textile finishes prepared from the nonylphenol 8 PO/8 EO product.

TABLE 10

| EMULSION STABILITY DATA | | | | |
|---|---|---|---|---|
| | | aqueous emulsion[a] | | |
| | Wt./Wt. | 10% | 15% | 20% |
| Lubricant - Coconut Oil | 80/20 | Stable[b] | Stable | Stable |
| Surfactant - NP 8PO/8EO | 70/30 | Stable | Stable | Stable |
| Ratio | 60/40 | Stable | Stable | Stable |
| | | aqueous emulsion[a] | | |
| | Wt./Wt. | 10% | 15% | 20% |
| Lubricant - Trimethylol- | 80/20 | Stable | Stable | Stable |
| propane Trispelargonate | 70/30 | Stable | Stable | Stable |
| Surfactant - NP 8PO/8EO | 60/40 | Stable | Stable | Stable |
| Ratio | | | | |
| | | aqueous emulsion[a] | | |

TABLE 10-continued

EMULSION STABILITY DATA

| | Wt./Wt. | 10% | 15% | 20% |
|---|---|---|---|---|
| Lubricant - Tridecyl Stearate | 80/20 | Un-stable | Un-stable | Un-stable |
| Surfactant - NP 8PO/8EO | 70/30 | Stable | Stable | Stable |
| Ratio | 60/40 | Stable | Stable | Stable |

[a]Concentration of the textile finish (lubricant/surfactant mixture) in water. Emulsion prepared at 25° C. (Vol./Vol.)
[b]Stable - emulsion stable for 24 hours or longer Micro - stable micro-emulsion formed

| | | aqueous emulsion[a] | | |
|---|---|---|---|---|
| | Wt./Wt. | 10% | 15% | 20% |
| Lubricant - Coconut Oil | 80/20 | Stable[b] | Stable | Stable |
| Surfactant - NP 8PO/8EO | 70/30 | Stable | Stable | Stable |
| Ratio | 60/40 | Micro | Micro | Micro |

| | | aqueous emulsion[a] | | |
|---|---|---|---|---|
| | Wt./Wt. | 10% | 15% | 20% |
| Lubricant - Trimethylol-propane Trispelargonate | 80/20 | Stable | Stable | Stable |
| Surfactant - NP 8PO/8EO | 70/30 | Stable | Stable | Stable |
| Ratio | 60/40 | Micro | Micro | Micro |

| | | aqueous emulsion[a] | | |
|---|---|---|---|---|
| | Wt./Wt. | 10% | 15% | 20 |
| Lubricant - Tridecyl Stearate | 80/20 | Un-stable | Un-stable | Un-stable |
| Surfactant - NP 8PO/8EO | 70/30 | Un-stable | Un-stable | Un-stable |
| Ratio | 60/40 | Micro | Micro | Micro |

[a]Concentration of the textile finish (lubricant/surfactant mixture) in water. Emulsion prepared at 70° C. (Vol./Vol.)
[b]Stable - emulsion stable for 24 hours or longer Micro - stable micro-emulsion formed

EXAMPLE 6

Preparation of Nonylphenol 10.5 PO/4.5 EO Block Polymer

Nonylphenol (413 g., 1.9 moles) was mixed with potassium hydroxide (4.0 g.) as described in Example 1. After water removal, propylene oxide (1145 g.) was added to the reactor. After the reaction period was complete, ethylene oxide was added to the system as described in Example 1 to a cloud point of 16° C. Product work-up gave a colorless liquid, molecular weight—1036, having excellent heat-stability and emulsification properties.

Evaluation of the Product

The following tests were run on the product to demonstrate satisfactory heat-stable properties:

| | |
|---|---|
| Smoke point | 200° C. |
| Volatility | 4.2 percent per hour leaving a liquid residue varnish |
| Thin-film residue on stainless steel | 0.9 percent residue which was a yellow varnish, hot soapy water removable |

Other physical properties were:

| | |
|---|---|
| Viscosity | 298 cks (centistokes) at 25° C. |
| Viscosity | 144 cks at 100° F. |
| Specific Gravity | 1.013 at 25° C. |
| Melting Point | <10° C. |
| Cloud Point | 16° C. |

The product was used to prepare textile finishes with different lubricants. The excellent heat-stability of these finishes can be seen in Table 11.

TABLE 11

HEAT STABILITY DATA

| | | 200° C. Volatility Test Percent per Hour | | |
|---|---|---|---|---|
| | Wt./Wt. | CO | TMP | TDS[a] |
| Lubricant/ Surfactant Ratio | 100/0 | 0.7 | 2.4 | 2.8 |
| | 80/20 | 1.1 | 2.6 | 3.6 |
| | 70/30 | 1.5 | 3.1 | 3.6 |
| | 60/40 | 1.6 | 3.1 | 4.6 |

As reference:
Neat Surfactant - 4.2

| | | 220° C. Residue Test Percent Residue | | |
|---|---|---|---|---|
| | Wt./Wt. | CO. | TMP | TDS |
| Lubricant/ Surfactant Ratio | 100/0 | 29.2 | 12.1 | 3.8 |
| | 80/20 | 38.4 [b] | 11.4 | 2.5 |
| | 70/30 | 34.3 [b] | 7.4 | 2.2 |
| | 60/40 | 29.1 [b] | 6.5 | 1.8 |

As reference:
Neat Surfactant - 0.9
[a] Lubricants: CO - coconut oil; TMP - trimethylolpropane trispelargonate; TDS - tridecyl stearate
[b] Liquid residue was obtained.

The following tests were carried out to show emulsion stability of textile finishes prepared from the nonylphenol 10.5 PO/4.5 EO product.

TABLE 12

EMULSION STABILITY DATA

| | | aqueous emulsion[a] | | |
|---|---|---|---|---|
| | Wt./Wt. | 10% | 15% | 20% |
| Lubricant - Coconut Oil | 80/20 | Stable[b] | Stable | Stable |
| Surfactant - NP | 70/30 | Stable | Stable | Stable |
| 10.5PO/4.5EO Ratio | 60/40 | Stable | Stable | Stable |

| | | aqueous emulsion[a] | | |
|---|---|---|---|---|
| | Wt./Wt. | 10% | 15% | 20% |
| Lubricant - Trimethylol-propane Trispelargonate | 80/20 | Stable | Stable | Stable |
| Surfactant - NP | 70/30 | Stable | Stable | Stable |
| 10.5PO/4.5EO Ratio | 60/40 | Stable | Stable | Stable |

| | | aqueous emulsion[a] | | |
|---|---|---|---|---|
| | Wt./Wt. | 10% | 15% | 20% |
| Lubricant - Tridecyl Stearate | 80/20 | Stable | Stable | Stable |
| Surfactant - NP | 70/30 | Stable | Stable | Stable |
| 10.5 PO/4.5EO Ratio | 60/40 | Stable | Stable | Stable |

[a]Concentration of the textile finish (lubricant/surfactant mixture) in water. Emulsion prepared at 25° C. (Vol./Vol.)
[b]Stable - emulsion stable for 24 hours or longer Micro - stable micro-emulsion formed

| | | aqueous emulsion[a] | | |
|---|---|---|---|---|
| | Wt./Wt. | 10% | 15% | 20% |
| Lubricant - Coconut Oil | 80/20 | Stable[b] | Stable | Stable |
| Surfactant - NP | 70/30 | Stable | Stable | Stable |
| 10.5PO/4.5EO Ratio | 60/40 | Micro | Micro | Micro |

| | | aqueous emulsion[a] | | |
|---|---|---|---|---|
| | Wt./Wt. | 10% | 15% | 20% |
| Lubricant - Trimethylol-propane Trispelargonate | 80/20 | Stable | Stable | Stable |
| Surfactant - NP | 70/30 | Stable | Stable | Stable |
| 10.5PO/4.5EO Ratio | 60/40 | Micro | Micro | Micro |

| | | aqueous emulsion[a] | | |
|---|---|---|---|---|
| | Wt./Wt. | 10% | 15% | 20% |
| Lubricant - Tridecyl Stearate | 80/20 | Stable | Stable | Stable |
| Surfactant - NP | 70/30 | Stable | Stable | Stable |
| | 60/40 | Micro | Micro | Micro |

TABLE 12-continued

| EMULSION STABILITY DATA | | | | |
|---|---|---|---|---|
| 10.5PO/4.5EO Ratio | | | | |

[a]Concentration of the textile finish (lubricant/surfactant mixture) in water. Emulsion prepared at 70° C. (Vol./Vol.)
[b]Stable - emulsion stable for 24 hours or longer Micro - stable micro-emulsion formed

EXAMPLE 7

Preparation of Nonylphenol 10.5 PO/6.3 EO Block Polymer

Nonylphenol (413 g., 1.9 moles) was mixed with potassium hydroxide (4.0 g.) as described in Example 1. After water removal, propylene oxide (1145 g.) was added to the reactor. After the reaction period was complete, ethylene oxide was added to the system as described in Example 1 and 6. At this point approximately 650 g. of reaction product was withdrawn from the reactor (see Example 6). The system then was closed and additional ethylene oxide was added to give a product having a cloud point of 25° C. Product work-up gave a colorless liquid, molecular weight—1114, having excellent heat-stability and emulsification properties.

Evaluation of the Product

The following tests were run on the product to demonstrate satisfactory heat-stable properties:

| | |
|---|---|
| Smoke point | 216° C. |
| Volatility | 5.1 percent per hour leaving a liquid residue varnish |
| Thin-film residue on stainless steel | 1.0 percent residue which was a yellow varnish, hot soap water removable |

Other physical properties were:

| | |
|---|---|
| Viscosity | 319 cks (centistokes) at 25° C. |
| Viscosity | 159 cks at 100° F. |
| Specific Gravity | 1.020 at 25° C. |
| Melting Point | > −10° C. |
| Cloud Point | 25° C. |

The product was used to prepare textile finishes with different lubricants. The excellent heat-stability of these finishes can be seen in Table 13.

TABLE 13

| HEAT STABILITY DATA | | | | |
|---|---|---|---|---|
| | | 200° C. Volatility Test Percent per Hour | | |
| | Wt./Wt. | CO | TMP | TDS[a] |
| Lubricant/ Surfactant Ratio | 100/0 | 0.7 | 2.4 | 2.8 |
| | 80/20 | 1.0 | 2.4 | 3.3 |
| | 70/30 | 1.3 | 2.6 | 3.6 |
| | 60/40 | 1.4 | 2.8 | 3.9 |

As reference: Neat Surfactant - 5.1

| | | 220° C. Residue Test Percent Residue | | |
|---|---|---|---|---|
| | Wt./Wt. | CO | TMP | TDS |
| Lubricant/ Surfactant Ratio | 100/0 | 30.3 | 12.5 | 3.8 |
| | 80/20 | 36.4[b] | 12.4 | 4.0 |
| | 70/30 | 29.6[b] | 9.0 | 4.0 |
| | 60/40 | 27.3[b] | 8.2 | 4.2 |

As reference: Neat Surfactant - 1.0
[a]Lubricants: CO-coconut oil; TMP-trimethylolpropane trispelargonate; TDS-tridecyl stearate
[b]Liquid residue was obtained The following tests were carried out to show emulsion stability of textile finishes prepared from the nonylphenol 10.5 PO/6.3 EO product.

TABLE 14

| EMULSION STABILITY DATA | | | | |
|---|---|---|---|---|
| | | aqueous emulsion[a] | | |
| | Wt./Wt. | 10% | 15% | 20% |
| Lubricant-Coconut Oil | 80/20 | Stable[b] | Stable | Stable |
| Surfactant-NP 10.5PO/ | 70/30 | Stable | Stable | Stable |
| 6.3EO Ratio | 60/40 | Stable | Stable | Stable |
| | | aqueous emulsion[a] | | |
| | Wt./Wt. | 10% | 15% | 20% |
| Lubricant-Trimethylol-propane Trispelargonate | 80/20 | Stable | Stable | Stable |
| Surfactant-NP 10.5PO/ | 70/30 | Stable | Stable | Stable |
| 6.3EO Ratio | 60/40 | Stable | Stable | Stable |
| | | aqueous emulsion[a] | | |
| | Wt./Wt. | 10% | 15% | 20% |
| Lubricant-Tridecyl Stearate | 80/20 | Stable | Stable | Stable |
| Surfactant-NP 10.5PO/ | 70/30 | Stable | Stable | Stable |
| 6.3EO Ratio | 60/40 | Stable | Stable | Stable |

[a]Concentration of the textile finish (lubricant/surfactant mixture) in water. Emulsion prepared at 25° C. (Vol./Vol.)
[b]Stable-emulsion stable for 24 hours or longer Micro-stable micro-emulsion formed

| | | aqueous emulsion[a] | | |
|---|---|---|---|---|
| | Wt./Wt. | 10% | 15% | 20%[a] |
| Lubricant-Coconut Oil | 80/20 | Stable[b] | Stable | Stable |
| Surfactant-NP 10.5PO/ | 70/30 | Stable | Stable | Stable |
| 6.3EO Ratio | 60/40 | Micro | Micro | Micro |
| | | aqueous emulsion[a] | | |
| | Wt./Wt. | 10% | 15% | 20% |
| Lubricant-Trimethylol-propane Trispelargonate | 80/20 | Stable | Stable | Stable |
| Surfactant-NP 10.5PO/ | 70/30 | Stable | Stable | Stable |
| 6.3EO Ratio | 60/40 | Micro | Micro | Micro |
| | | aqueous emulsion[a] | | |
| | Wt./Wt. | 10% | 15% | 20% |
| Lubricant-Tridecyl Stearate | 80/20 | Stable | Stable | Stable |
| Surfactant-NP 10.5PO/ | 70/30 | Stable | Stable | Stable |
| 6.3EO Ratio | 60/40 | Micro | Micro | Micro |

[a]Concentration of the textile finish (lubricant/surfactant mixture) in water. Emulsion prepared at 70° C. (Vol./Vol.)
[b]Stable-emulsion stable for 24 hours or longer Micro-stable micro-emulsion formed

EXAMPLE 8

Preparation of Nonylphenol 10.5 PO/8 EO Block Polymer

Nonylphenol (413 g., 1.9 moles) was mixed with potassium hydroxide (4.0 g.) as described in Example 1. After water removal, propylene oxide (1145 g.) was added to the reactor. After the reaction period was complete, ethylene oxide was added to the system as described in Example 1, 6 and 7. At this point approximately 620 g. of reaction product was withdrawn from the reactor (see Example 7). The system then was closed and additional ethylene oxide was added to give a product having a cloud point of 31° C. Product work-up gave a colorless liquid, molecular weight—1191, having excellent heat-stability and emulsification properties.

Evaluation of the Product

The following tests were run on the product to demonstrate satisfactory heat-stable properties:

| | |
|---|---|
| Smoke point | - 190° C. |
| Volatility | - 4.4 percent per hour leaving a liquid residue varnish |
| Thin-film residue on stainless steel | - 2.9 percent residue which was an amber varnish, hot soapy water removable |

Other physical properties were:

| | |
|---|---|
| Viscosity | - 340 cks (centistokes) at 25° C. |
| Viscosity | - 173 cks at 100° F. |
| Specific Gravity | - 1.025 at 25° C. |
| Melting Point | - <−10° C. |
| Cloud Point | - 31° C. |

The product was used to prepare textile finishes with different lubricants. The excellent heat-stability of these finishes can be seen in Table 15.

TABLE 15

HEAT STABILITY DATA

| | | 200° C. Volatility Test Percent per Hour | | |
|---|---|---|---|---|
| | Wt./Wt. | CO | TMP | TDS[a] |
| Lubricant/ Surfactant Ratio | 100/0 | 0.7 | 2.4 | 2.8 |
| | 80/20 | 1.5 | 2.7 | 3.4 |
| | 70/30 | 1.5 | 2.7 | 3.7 |
| | 60/40 | 1.8 | 2.7 | 3.8 |

As reference: Neat Surfactant - 4.4

| | | 220° C. Residue Test Percent Residue | | |
|---|---|---|---|---|
| | Wt./Wt. | CO | TMP | TDS |
| Lubricant/ Surfactant Ratio | 100/0 | 30.3 | 12.5 | 3.8 |
| | 80/20 | 33.1[b] | 10.5 | 4.0 |
| | 70/30 | 28.2[b] | 8.7 | 3.9 |
| | 60/40 | 27.3[b] | 8.0 | 3.6 |

As reference: Neat Surfactant - 2.9
[a]Lubricants: CO - coconut oil; TMP - trimethylolpropane trispelargonate; TDS - tridecyl stearate
[b]Liquid residue was obtained The following tests were carried out to show emulsion stability of textile finishes prepared from the nonylphenol 10.5 PO/8 EO product.

TABLE 16

EMULSION STABILITY DATA

| | | aqueous emulsion[a] | | |
|---|---|---|---|---|
| | Wt./Wt. | 10% | 15% | 20% |
| Lubricant - Coconut Oil | 80/20 | Stable[b] | Stable | Stable |
| Surfactant - | 70/30 | Stable | Stable | Stable |
| NP 10.5PO/8EO Ratio | 60/40 | Stable | Stable | Stable |

| | | aqueous emulsion[a] | | |
|---|---|---|---|---|
| | Wt./Wt. | 10% | 15% | 20% |
| Lubricant - trimethylol- | 80/20 | Stable | Stable | Stable |
| propane Trispelargonate | 70/30 | Stable | Stable | Stable |
| Surfactant - | 60/40 | Stable | Stable | Stable |
| NP 10.5PO/8EO Ratio | | | | |

| | | aqueous emulsion[a] | | |
|---|---|---|---|---|
| | Wt./Wt. | 10% | 15% | 20% |
| Lubricant - Tridecyl | 80/20 | Un-stable | Un-stable | Un-stable |
| Stearate | 70/30 | Stable | Stable | Stable |
| Surfactant - | 60/40 | Stable | Stable | Stable |
| NP 10.5PO/8EO Ratio | | | | |

[a]Concentration of the textile finish (lubricant/surfactant mixture) in water. Emulsion prepared at 25° C.(Vol./Vol.)
[b]Stable - emulsion stable for 24 hours or longer
Micro - stable micro-emulsion formed

| | | aqueous emulsion[a] | | |
|---|---|---|---|---|
| | Wt./Wt. | 10% | 15% | 20% |
| Lubricant - Coconut Oil | 80/20 | Stable[b] | Stable | Stable |
| Surfactant - | 70/30 | Stable | Stable | Stable |
| NP 10.5PO/8EO Ratio | 60/40 | Micro | Micro | Micro |

| | | aqueous emulsion[a] | | |
|---|---|---|---|---|
| | Wt./Wt. | 10% | 15% | 20% |
| Lubricant - Trimethylol- | 80/20 | Stable | Stable | Stable |
| propane Trispelargonate | 70/30 | Stable | Stable | Stable |
| Surfactant - | 60/40 | Micro | Micro | Micro |
| NP 10.5PO/8EO Ratio | | | | |

| | | aqueous emulsion[a] | | |
|---|---|---|---|---|
| | Wt./Wt. | 10% | 15% | 20% |
| Lubricant - Tridecyl | 80/20 | Stable | Un-stable | Un-stable |
| Stearate | 70/30 | Stable | Stable | Stable |
| Surfactant - | 60/40 | Micro | Micro | Micro |
| NP 10.5PO/8EO Ratio | | | | |

[a]Concentration of the textile finish (lubricant/surfactant mixture) in water. Emulsion prepared at 70° C. (Vol./Vol.)
[b]Stable - emulsion stable for 24 hours or longer
Micro - stable micro-emulsion formed

EXAMPLE 9

Preparation of Nonylphenol 12.5 PO/4 EO Block Polymer

Nonylphenol (430 g., 1.95 moles) was mixed with potassium hydroxide (4.0 g.) as described in Example 1. After water removal, propylene oxide (1414 g.) was added to the reactor. After the reaction period was complete, ethylene oxide was added to the system as described in Example 1 to a cloud point of 20° C. Product work-up gave a colorless liquid, molecular weight—1131, having marginal heat-stability but excellent emulsification properties.

Evaluation of the Product

The following tests were run on the product to demonstrate satisfactory heat-stable properties:

| | |
|---|---|
| Smoke point | - 215° C. |
| Volatility | - 2.3 percent per hour leaving a liquid residue varnish |
| Thin-film residue on stainless steel | - 0.5 percent residue which was a yellow varnish, hot soapy water removable |

Other physical properties were:

| | |
|---|---|
| Viscosity | - 315 cks (centistokes) at 25° C. |
| Viscosity | - 156 cks at 100° F. |
| Specific Gravity | - 1.007 at 25° C. |
| Melting Point | - <−10° C. |
| Cloud Point | - 20° C. |

The product was used to preapre textile finishes with different lubricants. The excellent heat-stability of these finishes can be seen in Table 17.

TABLE 17

HEAT STABILITY DATA

| | Wt./Wt. | 220° C. Residue Test Percent Residue CO | TMP | TDS |
|---|---|---|---|---|
| Lubricant/ Surfactant Ratio | 100/0 | 32.5 | 12.0 | 4.0 |
| | 80/20 | 50.6[b] | 11.7[b] | 4.1 |
| | 70/30 | 42.0[b] | 11.1[b] | 3.3 |
| | 60/40 | 35.7[b] | 9.6[b] | 3.6 |

As reference: Neat Surfactant - 0.5
[a]Lubricants: CO - coconut oil; TMP - trimethylolpropane trispelargonate; TDS - tridecyl stearate
[b]Liquid residue was obtained The following tests were carried out to show emulsion stability of textile finishes prepared from the nonylphenol 12.5 PO/4 EO product.

TABLE 18

EMULSION STABILITY DATA

| | Wt./Wt. | aqueous emulsion[a] 10% | 15% | 20% |
|---|---|---|---|---|
| Lubricant - Coconut Oil | 80/20 | Stable[b] | Stable | Stable |
| Surfactant - | 70/30 | Stable | Stable | Stable |
| NP 12.5PO/4EO Ratio | 60/40 | Stable | Stable | Stable |
| | Wt./Wt. | aqueous emulsion[a] 10% | 15% | 20% |
| Lubricant - Trimethylol- | 80/20 | Stable | Stable | Stable |
| propane Trispelargonate | 70/30 | Stable | Stable | Stable |
| Surfactant - | 60/40 | Stable | Stable | Stable |
| NP 12.5PO/4EO Ratio | | | | |
| | Wt./Wt. | aqueous emulsion[a] 10% | 15% | 20% |
| Lubricant - Tridecyl | 80/20 | Stable | Stable | Stable |
| Stearate | 70/30 | Stable | Stable | Stable |
| Surfactant - | 60/40 | Stable | Stable | Stable |
| NP 12.5PO/4EO Ratio | | | | |

[a]Concentration of the textile finish (lubricant/surfactant mixture) in water. Emulsion prepared at 25° C.(Vol./Vol.)
[b]Stable - emulsion stable for 24 hours or longer
- stable micro-emulsion formed

| | Wt./Wt. | aqueous emulsion[a] 10% | 15% | 20% |
|---|---|---|---|---|
| Lubricant - Coconut Oil | 80/20 | Stable[b] | Stable | Stable |
| Surfactant - | 70/30 | Stable | Stable | Stable |
| NP 12.5PO/4EO Ratio | 60/40 | Stable | Stable | Stable |
| | Wt./Wt. | aqueous emulsion[a] 10% | 15% | 20% |
| Lubricant - Trimethylol- | 80/20 | Stable | Stable | Stable |
| propane Trispelargonate | 70/30 | Stable | Stable | Stable |
| Surfactant - | 60/40 | Stable | Stable | Stable |
| NP 12.5PO/4EO Ratio | | | | |
| | Wt./Wt. | aqueous emulsion[a] 10% | 15% | 20% |
| Lubricant - Tridecyl | 80/20 | Stable | Stable | Stable |
| Stearate | 70/30 | Stable | Stable | Stable |
| Surfactant - | 60/40 | Stable | Stable | Stable |
| NP 12.5PO/4EO Ratio | | | | |

[a]Concentration of the textile finish (lubricant/surfactant mixture) in water. Emulsion prepared at 70° C. (Vol./Vol.)
[b]Stable - emulsion stable for 24 hours or longer
Micro - stable micro-emulsion formed

EXAMPLE 10

Preparation of Nonylphenol 12.5 PO/6 EO Block Polymer

Nonylphenol (430 g., 1.95 moles) was mixed with potassium hydroxide (4.0 g.) as described in Example 1. After water removal, propylene oxide (1414 g.) was added to the reactor. After the reaction period was complete, ethylene oxide was added to the system as described in Example 1 and 9. At this point approximately 500 g. of reaction product was withdrawn from the reactor (see Example 9). The system then was closed and additional ethylene oxide was added to give a product having a cloud point of 30° C. Product work-up gave a colorless liquid; molecular weight—1202, having excellent heatstability and emulsification properties.

Evaluation of the Product

The following tests were run on the product to demonstrate satisfactory heat-stable properties:

| | |
|---|---|
| Smoke point | - 222° C. |
| Volatility | - 2.7 percent per hour leaving a liquid residue varnish |
| Thin-film residue on stainless steel | - 0.7 percent residue which was a yellow varnish, hot soapy water removable |

Other physical properties were:

| | |
|---|---|
| Viscosity | - 331 cks (centistokes) at 25° C. |
| Viscosity | - 158 cks at 100° F. |
| Specific Gravity | - 1.013 at 25° C. |
| Melting Point | - <−10° C. |
| Cloud Point | - 30° C. |

The product was used to prepare textile finishes with different lubricants. The excellent heatstability of these finishes can be seen in Table 19.

TABLE 19

HEAT STABILITY DATA

| | Wt./Wt. | 220° C. Residue Test Percent Residue CO | TMP | TDS |
|---|---|---|---|---|
| Lubricant/ Surfactant Ratio | 100/0 | 32.5 | 12.0 | 4.0 |
| | 80/20 | 42.6[b] | 12.9 | 4.0 |
| | 70/30 | 42.8[b] | 9.8[b] | 4.3 |
| | 60/40 | 33.0[b] | 9.3[b] | 4.1 |

As reference: Neat Surfactant - 0.7
[a]Lubricants: CO - coconut oil; TMP - trimethylolpropane trispelargonate; TDS - tridecyl stearate
[b]Liquid residue was obtained The following tests were carried out to show emulsion stability of textile finishes prepared from the nonylphenol 12.5 PO/6 EO product.

TABLE 20

EMULSION STABILITY DATA

| | Wt./Wt | aqueous emulsion[a] 10% | 15% | 20% |
|---|---|---|---|---|
| Lubricant - Coconut Oil | 80/20 | Stable[b] | Stable | Stable |
| Surfactant - | 70/30 | Stable | Stable | Stable |
| NP 12.5PO/4EO Ratio | 60/40 | Stable | Stable | Stable |
| | Wt./Wt. | aqueous emulsion[a] 10% | 15% | 20% |
| Lubricant - Trimethylol- | 80/20 | Stable | Stable | Stable |
| propane Trispelargonate | 70/30 | Stable | Stable | Stable |
| Surfactant - | 60/40 | Stable | Stable | Stable |
| NP 12.5PO/6EO Ratio | | | | |

TABLE 20-continued

EMULSION STABILITY DATA

| | Wt./Wt. | aqueous emulsion[a] 10% | 15% | 20% |
|---|---|---|---|---|
| Lubricant - Tridecyl Stearate Surfactant - NP 12.5PO/6ED Ratio | 80/20 | Stable | Stable | — |
| | 70/30 | Stable | Stable | — |
| | 60/40 | Stable | Stable | Stable |

[a]Concentration of the textile finish (lubricant/surfactant mixture) in water. Emulsion prepared at 25° C. (Vol./Vol.)
[b]Stable - emulsion stable for 24 hours or longer Micro - stable micro-emulsion formed

| | Wt./Wt. | aqueous emulsion[a] 10% | 15% | 29% |
|---|---|---|---|---|
| Lubricant - Coconut Oil Surfactant - NP 12.5PO/4EO Ratio | 80/20 | Stable[b] | Stable | Stable |
| | 70/30 | Stable | Stable | Stable |
| | 60/40 | Stable | Stable | Stable |

| | Wt./Wt. | aqueous emulsion[a] 10% | 15% | 20% |
|---|---|---|---|---|
| Lubricant - Trimethylolpropane Trispelargonate Surfactant - NP 12.5PO/6EO Ratio | 80/20 | Stable | Stable | Stable |
| | 70/30 | Stable | Stable | Stable |
| | 60/40 | Stable | Stable | Stable |

| | Wt./Wt. | aqueous emulsion[a] 10% | 15% | 20% |
|---|---|---|---|---|
| Lubricant - Tridecyl Stearate Surfactant - NP 12.5PO/6EO Ratio | 80/20 | Stable | Stable | Stable |
| | 70/30 | Stable | Stable | Stable |
| | 60/40 | Stable | Stable | Stable |

[a]Concentration of the textile finish (lubricant/surfactant mixture) in water. Emulsion prepared at 70° C. (Vol./Vol.)
[b]Stable - emulsion stable for 24 hours or longer
Micro - stable micro-emulsion formed

EXAMPLE 11

Preparation of Nonylphenol 12.5 PO/7.5 EO Block Polymer

Nonylphenol (430 g., 1.95 moles) was mixed with potassium hydroxide (4.0 g.) as described in Example 1. After water removal, propylene oxide (1414 g.) was added to the reactor. After the reaction period was complete, ethylene oxide was added to the system as described in Example 1, 9 and 10. At this point approximately 500 g. of reaction product was withdrawn from the reactor (see Example 10). The system then was closed and additional ethylene oxide was added to give a product having a cloud point of 43° C. Product work-up gave a colorless liquid, molecular weight—1285, having excellent heat-stability and emulsification properties.

Evaluation of the Product

The following tests were run on the product to demonstrate satisfactory heat-stable properties:

| | |
|---|---|
| Smoke Point | - 223° C. |
| Volatility | - 2.5 percent per hour leaving a liquid residue varnish |
| Thin-film residue on stainless steel | - 1.0 percent residue which was a yellow varnish, hot soapy water removable |

Other physical properties were:

| | |
|---|---|
| Viscosity | - 349 cks (centistokes) at 25° C. |
| Viscosity | - 169 cks at 100° F. |

-continued

| | |
|---|---|
| Specific Gravity | - 1.020 at 25° C. |
| Melting Point | - −7° C. |
| Cloud Point | - 43° C. |

The product was used to prepare textile finishes with different lubricants. The excellent heatstability of these finishes can be seen in Table 21.

TABLE 21

HEAT STABILITY DATA

| | Wt./Wt. | 200° C. Volatility Test Percent per Hour CO | TMP | TDS[a] |
|---|---|---|---|---|
| Lubricant/ Surfactant Ratio | 100/0 | 0.8 | 2.3 | 2.8 |
| | 80/20 | 1.0 | 2.6 | 4.8 |
| | 70/30 | 1.7 | 2.4 | 4.1 |
| | 60/40 | 1.9 | 2.8 | 4.0 |

As reference: Neat Surfactant - 2.5

| | Wt./Wt. | 220° C. Residue Test Percent Residue CO | TMP | TDS |
|---|---|---|---|---|
| Lubricant/ Surfactant Ratio | 100/0 | 32.5 | 12.0 | 4.0 |
| | 80/20 | 46.5[b] | 12.0[b] | 3.6 |
| | 70/30 | 38.6[b] | 10.0[b] | 3.2 |
| | 60/40 | 31.7[b] | 8.4[b] | 3.7 |

As reference: Neat Surfactant - 1.0
[a]Lubricants: CO - coconut oil; TMP - trimethylolpropane trisperlargonate; TDS - tridecyl stearate
[b]Liquid residue was obtained The following tests were carried out to show emulsion stability of textile finishes prepared from the nonylphenol 12.5 PO/7.5 EO product.

TABLE 22

EMULSION STABILITY DATA

| | Wt./Wt. | aqueous emulsion[a] 10% | 15% | 20% |
|---|---|---|---|---|
| Lubricant - Coconut Oil Surfactant - NP 12.5PO/7.5EO Ratio | 80/20 | Stable[b] | Stable | Stable |
| | 70/30 | Stable | Stable | Stable |
| | 60/40 | Stable | Stable | Stable |

| | Wt./Wt. | aqueous emulsion[a] 10% | 15% | 20% |
|---|---|---|---|---|
| Lubricant - Trimethylolpropane Trispelargonate Surfactant - NP 12.5PO/7.5EO Ratio | 80/20 | Stable | Stable | Stable |
| | 70/30 | Stable | Stable | Stable |
| | 60/40 | Stable | Stable | Stable |

| | Wt./Wt. | aqueous emulsion[a] 10% | 15% | 20% |
|---|---|---|---|---|
| Lubricant - Tridecyl Stearate Surfactant - NP 12.5PO/7.5EO Ratio | 80/20 | Stable | Stable | Stable |
| | 70/30 | Stable | Stable | Stable |
| | 60/40 | Stable | Stable | Stable |

[a]Concentration of the textile finish (lubricant/surfactant mixture) in water. Emulsion prepared at 25° C. (Vol./Vol.)
[b]Stable - emulsion stable for 24 hours or longer Micro - stable micro-emulsion formed

| | Wt./Wt. | aqueous emulsion[a] 10% | 15% | 20% |
|---|---|---|---|---|
| Lubricant - Coconut Oil Surfactant - NP 12.5PO/7.5EO Ratio | 80/20 | Stable[b] | Stable | Stable |
| | 70/30 | Stable | Stable | Stable |
| | 60/40 | Micro | Micro | Micro |

| | Wt./Wt. | aqueous emulsion[a] 10% | 15% | 20% |
|---|---|---|---|---|
| Lubricant - Trimethylolpropane Trispelargonate Surfactant - | 80/20 | Stable | Stable | Stable |
| | 70/30 | Stable | Stable | Stable |
| | 60/40 | Micro | Micro | Micro |

TABLE 22-continued

| EMULSION STABILITY DATA | | | | |
|---|---|---|---|---|
| NP 12.5PO/7.5EO Ratio | | | | |
| | | aqueous emulsion[a] | | |
| | Wt./Wt. | 10% | 15% | 20% |
| Lubricant - Tridecyl Stearate | 80/20 | Stable | Stable | Stable |
| Surfactant NP 12.5PO/7.5EO Ratio | 70/30 | Stable | Stable | Stable |
| | 60/40 | Micro | Micro | Micro |

[a]Concentration of the textile finish (lubricant/surfactant mixture) in water. Emulsion prepared at 70° C. (Vol./Vol.)
[b]Stable - emulsion stable for 24 hours or longer
Micro - stable micro-emulsion formed

CONTROL B

Preparation of Nonylphenol 6 PO/11 EO Random Polymer

Nonylphenol (1,080 g., 4.9 moles) was mixed with potassium hydroxide (5.5 g.) as described in Example 1. After water removal, a mixture of propylene oxide and ethylene oxide (4,090 g.), in a weight ratio of 58.2 percent EO and 41.8 percent PO or an 11 to 6/EO to PO molar ratio, was added as described in Example 1. Product work-up gave a colorless liquid, molecular weight—1014, having excellent heat-stability but poor emulsification properties.

Evaluation of the Product

The following tests were run on the product to demonstrate satisfactory heat-stable properties:

| | |
|---|---|
| Smoke point | - 198° C. |
| Volatility | - 2.0 percent per hour leaving an amber liquid residue |
| Thin-film residue on aluminum | - 4.8 percent residue which was a yellow liquid, hot soapy-water removable |

Other physical properties were:

| | |
|---|---|
| Viscosity | - 250 cks (centistokes) at 25° C. |
| Viscosity | - 126 cks at 100° F. |
| Specific Gravity | - 1.041 at 25° C. |
| Melting Point | - 0° C. |
| Cloud Point | - 50° C. |

The following tests were carried out to show emulsion effectiveness:

| | |
|---|---|
| 24-Hour Emulsion Stability - | as shown in Table 23 at 25° C. |

The following tests were carried out to show emulsion stability of textile finishes prepared from the nonylphenol 6 PO/11 EO random product.

TABLE 23

| EMULSION STABILITY DATA | | | | |
|---|---|---|---|---|
| | | aqueous emulsion[a] | | |
| | Wt./Wt. | 10% | 15% | 20% |
| Lubricant - Coconut Oil Surfactant - NP 6PO/11EO Ratio | 80/20 | Unstable[b] | Unstable | Unstable |
| | 70/30 | Unstable | Unstable | Unstable |
| | 60/40 | Unstable | Unstable | Unstable |
| | | aqueous emulsion[a] | | |
| | Wt./Wt. | 10% | 15% | 20% |
| Lubricant - Trimethylolpropane Trispelargonate Surfactant - NP 6PO/11EO Ratio | 80/20 | Unstable | Unstable | Unstable |
| | 70/30 | Unstable | Unstable | Unstable |
| | 60/40 | Unstable | Unstable | Unstable |
| | | aqueous emulsion[a] | | |
| | Wt./Wt. | 10% | 15% | 20% |
| Lubricant - Tridecyl Stearate Surfactant - NP 6PO/11EO Ratio | 80/20 | Unstable | Unstable | Unstable |
| | 70/30 | Unstable | Unstable | Unstable |
| | 60/40 | Unstable | Unstable | Unstable |

[a]Concentration of the textile finish (lubricant/surfactant mixture) in water. Emulsion prepared at 25° C. (Vol./Vol.)
[b]Stable - emulsion stable for 24 hours or longer
Micro - stable micro-emulsion formed The following tests show the unsatisfactory emulsion stability of textile finishes prepared from the nonylphenol 8 PO/8 EO random product.

TABLE 24

| EMULSION STABILITY DATA | | | | |
|---|---|---|---|---|
| | | aqueous emulsion[a] | | |
| | Wt./Wt. | 10% | 15% | 20% |
| Lubricant - Coconut Oil Surfactant - NP 8PO/8EO Ratio | 80/20 | Unstable[b] | Unstable | Unstable |
| | 70/30 | Unstable | Unstable | Unstable |
| | 60/40 | Unstable | Unstable | Unstable |
| | | aqueous emulsion[a] | | |
| | Wt./Wt. | 10% | 15% | 20% |
| Lubricant - Trimethylol - propane Trispelargonate Surfactant - NP 8PO/8EO Ratio | 80/20 | Unstable | Unstable | Unstable |
| | 70/30 | Unstable | Unstable | Unstable |
| | 60/40 | Unstable | Unstable | Unstable |
| | | aqueous emulsion[a] | | |
| | Wt./Wt. | 10% | 15% | 20% |
| Lubricant - Tridecyl Stearate Surfactant - NP 8PO/8EO Ratio | 80/20 | Unstable | Unstable | Unstable |
| | 70/30 | Unstable | Unstable | Unstable |
| | 60/40 | Unstable | Unstable | Unstable |

[a]Concentration of the textile finish (lubricant/surfactant mixture) in water. Emulsion prepared at 25° C. (Vol./Vol.)
[b]Stable - emulsion stable for 24 hours or longer
Micro - stable micro-emulsion formed

CONTROL C

Preparation of Nonylphenol 8 PO/8 EO Random Polymer

Nonylphenol (662 g., 3.0 moles) was mixed with potassium hydroxide (6.0 g.) as described in Example 1. After water removal, a mixture of propylene oxide and ethylene oxide (2,455 g.), in a weight ratio of 43.1 percent EO and 56.9 percent PO or an 8 to 8/EO to PO molar ratio, was added as described in Example 1. Product work-up gave a colorless liquid, molecular weight—1020, having excellent heat-stability but poor emulsification properties.

Evaluation of the Product

The following tests were run on the product to demonstrate satisfactory heat-stable properties:

| | |
|---|---|
| Smoke point | - 201° C. |
| Volatility | - 5.6 percent per hour leaving an amber liquid residue |
| Thin-film residue on aluminum | - 0.7 percent residue which was a yellow stain, hot soapy-water nonremovable |

Other physical properties were:

| | |
|---|---|
| Viscosity | - 242 cks (centistokes) at 25° C. |
| Viscosity | - 122 cks at 100° F. |
| Specific Gravity | - 1.026 at 25° C. |
| Melting Point | - <0° C. |
| Cloud Point | - 34° C. |

CONTROL D

Preparation of Hexadecylphenol 4 PO/10 EO Block Polymer

Hexadecylphenol (252 g., 0.79 moles) was mixed with potassium hydroxide (3.0 g.) as described in Example 1. After water removal, propylene oxide (184 g.) was added to the reactor. After the reaction period was complete, ethylene oxide (285 g.) was added to the system as described in Example 1. Product work-up gave a pale yellow liquid, molecular weight—983, having unsatisfactory heat-stability and emulsification properties.

Evaluation of the Product

The following tests were run on the product to demonstrate satisfactory heat-stable properties:

| | |
|---|---|
| Smoke point | - 176° C. |
| Volatility | - 1.4 percent per hour leaving a brown liquid residue |
| Thin-film residue on aluminum | - 28.4 percent residue which was a yellow liquid, hot soapy-water nonremovable |

Other physical properties were:

| | |
|---|---|
| Viscosity | - 230 cks (centistokes) at 25° C. |
| Viscosity | - 115 cks at 100° F. |
| Specific Gravity | - 1.006 at 25° C. |
| Melting Point | - 0° C. |
| Cloud Point | - 0° C. |
| 24-Hour Emulsion Stability | - is shown in the following Table at 25° C. |

The following tests show the unsatisfactory emulsion stability of textile finishes prepared from the hexadecylphenol 4 PO/10 EO product.

TABLE 25

EMULSION STABILITY DATA

| | | aqueous emulsion[a] | | |
|---|---|---|---|---|
| | Wt./Wt. | 10% | 15% | 20% |
| Lubricant - Coconut Oil | 80/20 | Unstable[b] | Unstable | Unstable |
| | 70/30 | Stable | Stable | Unstable |
| Surfactant - HDP 4PO/10EO Ratio | 60/40 | Stable | Stable | Unstable |
| | | aqueous emulsion[a] | | |
| | Wt./Wt. | 10% | 15% | 20% |
| Lubricant - Trimethylolpropane Trispelargonate | 80/20 | Unstable | Unstable | Unstable |
| | 70/30 | Unstable | Unstable | Unstable |
| | 60/40 | Stable | Stable | Unstable |
| Surfactant - HDP 4PO/10EO Ratio | | | | |
| | | aqueous emulsion[a] | | |
| | Wt./Wt. | 10% | 15% | 20% |
| Lubricant - Tridecyl Stearate | 80/20 | Unstable | Unstable | Unstable |
| | 70/30 | Unstable | Unstable | Unstable |
| Surfactant - HDP 4PO/10EO Ratio | 60/40 | Stable | Unstable | Unstable |

[a]Concentration of the textile finish (lubricant/surfactant mixture) in water. Emulsion prepared at 25° C. (Vol./Vol.)
[b]Stable - emulsion stable for 24 hours or longer Micro - stable micro-emulsion formed

Evaluation of Nonylphenol 8 PO/6.5 EO Block Polymers in a Textile Finish

The nonylphenol 8 PO/6.5 EO block polymer (prepared in Example 3) was mixed with conventional high temperature lubricants and the thermal and emulsion stability properties of the finishes were measured. Coconut oil, trimethylolpropane trispelargonate, and tridecyl stearate were each mixed with the nonylphenol PO/EO block polymer surfactant at lubricant/surfactant weight ratios of 80/20, 70/30 and 60/40. The volatilities (percent weight loss/hr.) at 200° C. and the formation of residues (weight percent remaining) at 220° C. of the finishes were assessed. Example 3 reveals that the volatilities of the coconut oil and trimethylolpropane trispelargonate finishes were low and that the volatilities are a function of the weight percent lubricant/surfactant ratio. The tridecyl stearate finishes exhibit low volatilities also, but the volatilities are a function of the sum of the component volatilities. The weight percent residues at 220° C. of the trimethylolpropane trispelargonate and tridecyl stearate finishes (shown in Table 4) are low and the percent residue is proportional to lubricant/surfactant ratio. The residues of the coconut oil finishes are high and are not proportional to the lubricant/surfactant ratio nor the sum of the component residues. In addition, whereas the neo-alcohol ester and fatty acid ester finishes produce a hard varnish residue, the coconut oil finishes produce liquid residues.

The aqueous emulsion stabilities of the various nonylphenol 8 PO/6.5 EO block polymer surfactant containing finishes were assessed at room temperature over a 24-hour period. The emulsions were prepared at room temperature and at 70° C. The emulsion stabilities of the heated finishes were cooled to room temperature before observing for stability. Example 3 indicates that stable white emulsions at all emulsion concentrations and at all lubricant/surfactant ratios were obtained at room temperature. Upon heating the emulsions at 70° C. for 30 minutes and cooling to room temperature, microemulsions at the 60/40 finish composition were obtained.

Increasing the EO content of the nonylphenol PO/PE block polymer surfactant from 6.5 EO to 7.5

EO does not alter the emulsion characteristics of the finishes. The thermal properties are unchanged as well as demonstrated in Example 4.

Increasing the EO content of the surfactant to 8 EO alters the emulsification properties of the block polymer. The tridecyl stearate emulsions are unstable at lubricant/surfactant weight ratios of 80/20 at room temperature make-up and 80/20 and 70/30 at 70° C. make-up. Example 5 reveals that the coconut oil and trimethylolpropane trispelargonate emulsions remain unchanged compared to 6.5 EO containing block polymer. Increasing the EO content of the surfactant did not alter the thermal properties of the block polymer: low residues (with the exception of coconut oil) and volatilities of the finishes are retained.

Evaluation of Nonylphenol 10.5 PO/EO Block Polymers

Nonylphenol 10.5 PO/EO block polymer surfactants containing 4.5, 6.3, 7 and 8 moles EO were evaluated according to the procedures used on the nonylphenol 8 PO/EO polymers as revealed in Examples 5, 6, 7 and 8. Their thermal behaviors are analogous to the nonylphenol 8 PO/6.5 EO block polymers. The emulsion data reveal that at high EO content the tridecyl stearate/-nonylphenol 10.5 PO/8 EO surfactant finishes exhibit poorer emulsion stability compared to the coconut oil and trimethylolpropane trispelargonate containing finishes. The overall emulsion stabilities on the nonylphenol 10.5 PO/4.5, 6.3 and 8 EO surfactants are comparable to the nonylphenol 8 PO/6.5 EO polymers.

Evaluation of Nonylphenol 12.5 PO/EO Block Copolymers

Nonylphenol 12.5 PO/EO block polymer surfactants containing 4, 6 and 7.5 moles EO were evaluated according to the procedures of Examples 6, 7 and 8. The data in Examples 9, 10 and 11 indicate that the weight percent residues at 220° C. of the coconut oil and trimethylolpropane trispelargonate finishes are liquid. In addition, whereas the trimethylolpropane trispelargonate and tridecyl stearate finishes exhibit residues proportional to the lubricant/surfactant ratio, the coconut oil finishes do not. In all cases the residues of the coconut oil finishes are greater than expected.

The aqueous emulsion stabilities of the nonylphenol 12.5 PO/EO surfactants depicted in Examples 9, 10 and 11 reveal that stable white emulsions similar to those of the nonylphenol 8 PO/6.5 EO system are obtained. However, unlike the nonylphenol 8 PO/EO and nonylphenol 10.5 PO/EO block polymers which all produced microemulsions at the 60/40 oil/surfactant ratio upon heating to 70° C., only the nonylphenol 12.5 PO/7.5 EO surfactant produced the microemulsion on heating to 70° C.

CONTROLS E, F and G

Evaluation of Prior Art Surfactants

The thermal properties of ethoxylated nonylphenols are similar to the nonylphenol PO/EO block polymers with the exception that the nonylphenol ethoxylates display lower smoke points and the coconut oil based finishes produced varnish residues instead of liquid residues. The data in Tables 26, 27, 27a, 28, 29 and 29*a* depict the thermal properties of six and seven mole ethoxylates of nonylphenol. The emulsification properties of the nonylphenol ethoxylates are greatly inferior to the block polymer surfactants as revealed in the tables. The seven mole ethoxylate of nonylphenol failed to produce a single stable emulsion. The nonylphenol 6 EO surfactant produced only stable emulsions of coconut oil and tridecyl stearate at 70/30 and 60/40 lubricant/surfactant finishes after heating at 70° C.

Dodecylphenol ethoxylates produce superior emulsions compared to the nonylphenol ethoxylates. However, the dodecylphenol ethoxylates are inferior to the nonylphenol PO/EO block polymer surfactants. Tables 30 and 31 reveal that tridecyl stearate finish emulsions only are comparable to the block polymer containing finishes. The dodecylphenol ethoxylates fail to produce microemulsions following heating at 70° C. and none of the finish systems display stable emulsions over the complete lubricant/surfactant ratio range.

NONYLPHENOL 6 EO

The product was used to prepare textile finishes with different lubricants. The excellent heat-stability of these finishes can be demonstrated.

TABLE 26

HEAT STABILITY DATA

| | | 200° C. Volatility Test Percent per Hour | | |
|---|---|---|---|---|
| | Wt./Wt. | CO | TMP | TDS[a] |
| Lubricant/ Surfactant Ratio | 100/0 | 0.7 | 2.4 | 2.8 |
| | 80/20 | 2.2 | 3.1 | 4.8 |
| | 70/30 | 2.2 | 2.7 | 4.2 |
| | 60/40 | 3.0 | 4.1 | 4.9 |

As reference: Neat Surfactant - 2.5

| | | 220° C. Residue Test Percent Residue | | |
|---|---|---|---|---|
| | Wt./Wt. | CO | TMP | TDS |
| Lubricant/ Surfactant Ratio | 100/0 | 32.5 | 12.0 | 4.0 |
| | 80/20 | 28.4 | 9.3 | — |
| | 70/30 | 24.9 | 7.6 | — |
| | 60/40 | 22.4 | 9.1 | 2.0 |

As reference: Neat Surfactant - 4.6

[a]Lubricants: CO - coconut oil;TMP - trimethylolpropane trispelargonate; TDS - tridecyl stearate

[b]Liquid residue was obtained

The following tests were carried out to show emulsion stability of textile finishes prepared from the nonylphenol 6 EO product.

TABLE 27

EMULSION STABILITY DATA

| | | aqueous emulsion[a] | | |
|---|---|---|---|---|
| | Wt./Wt. | 10% | 15% | 20% |
| Lubricant - Coconut Oil Surfactant - NP 6EO Ratio | 80/20 | Unstable[b] | Unstable | Unstable |
| | 70/30 | Unstable | Unstable | Unstable |
| | 60/40 | Unstable | Unstable | Unstable |

| | | aqueous emulsion[a] | | |
|---|---|---|---|---|
| | Wt./Wt. | 10% | 15% | 20% |
| Lubricant - Trimethylolpropane Trispelargonate Surfactant - NP 6EO Ratio | 80/20 | Unstable | Unstable | Unstable |
| | 70/30 | Unstable | Unstable | Unstable |
| | 60/40 | Unstable | Unstable | Unstable |

| | | aqueous emulsion[a] | | |
|---|---|---|---|---|
| | Wt./Wt. | 10% | 15% | 20% |
| Lubricant - Tridecyl Stearate Surfactant - NP | 80/20 | Unstable | Unstable | Unstable |
| | 70/30 | Unstable | Unstable | Unstable |
| | 60/40 | Unstable | Unstable | Unstable |

TABLE 27-continued

EMULSION STABILITY DATA

6EO Ratio

[a]Concentration of the textile finish (lubricant/surfactant mixture) in water. Emulsion prepared at 25° C. (Vol./Vol.)
[b]Stable - emulsion stable for 24 hours or longer Micro - stable micro-emulsion formed

| | | aqueous emulsion[a] | | |
|---|---|---|---|---|
| | Wt./Wt. | 10% | 15% | 20% |
| Lubricant - Coconut Oil Surfactant - NP 6EO Ratio | 80/20 | Unstable[b] | Unstable | Unstable |
| | 70/30 | Unstable | Stable | Stable |
| | 60/40 | Stable | Stable | Stable |

| | | aqueous emulsion[a] | | |
|---|---|---|---|---|
| | Wt./Wt. | 10% | 15% | 20% |
| Lubricant - Trimethylolpropane Trispelargonate Surfactant - NP 6EO Ratio | 80/20 | Unstable | Unstable | Unstable |
| | 70/30 | Unstable | Unstable | Unstable |
| | 60/40 | Unstable | Unstable | Unstable |

| | | aqueous emulsion[a] | | |
|---|---|---|---|---|
| | Wt./Wt. | 10% | 15% | 20% |
| Lubricant - Tridecyl Stearate Surfactant - NP 6EO Ratio | 80/20 | Unstable | Unstable | Stable |
| | 70/30 | Stable | Stable | Stable |
| | 60/40 | Stable | Stable | Stable |

[a]Concentration of the textile finish (lubricant/surfactant mixture) in water. Emulsion prepared at 70° C. (Vol./Vol.)
[b]Stable - emulsion stable for 24 hours or longer Micro - stable micro-emulsion formed

NONYLPHENOL 7 EO

The product was used to prepare textile finishes with different lubricants. The excellent heat-stability of these finishes can be demonstrated.

TABLE 28

HEAT STABILITY DATA

| | | 200° C. Volatility Test Percent per Hour | | |
|---|---|---|---|---|
| | Wt./Wt. | CO | TMP | TDS[a] |
| Lubricant/ Surfactant Ratio | 100/0 | 0.7 | 2.4 | 2.8 |
| | 80/20 | 1.2 | 1.9 | 4.5 |
| | 70/30 | 1.6 | 2.4 | 4.6 |
| | 60/40 | 4.1 | 2.5 | 4.1 |

As reference: Neat Surfactant - 1.0

| | | 220° C. Residue Test Percent Residue | | |
|---|---|---|---|---|
| | Wt./Wt. | CO | TMP | TDS |
| Lubricant/ Surfactant Ratio | 100/0 | 32.5 | 12.0 | 4.0 |
| | 80/20 | 41.6 | 10.6 | — |
| | 70/30 | 38.7 | 8.3 | — |
| | 60/40 | 37.0 | 8.7 | 3.7 |

As reference: Neat Surfactant - 3.5
[a]Lubricants: CO-coconut oil; TMP-trimethylolpropane trispelargonate; TDS-tridecyl stearate
[b]Liquid residue was obtained The following tests were carried out to show emulsion stability of textile finishes prepared from the nonylphenol 7 EO product.

TABLE 29

EMULSION STABILITY DATA

| | | aqueous emulsion[a] | | |
|---|---|---|---|---|
| | Wt./Wt. | 10% | 15% | 20% |
| Lubricant - Coconut Oil Surfactant - NP 7EO Ratio | 80/20 | Unstable[b] | Unstable | Unstable |
| | 70/30 | Unstable | Unstable | Unstable |
| | 60/40 | Unstable | Unstable | Unstable |

TABLE 29-continued

EMULSION STABILITY DATA

| | Wt./Wt. | 10% | 15% | 20% |
|---|---|---|---|---|
| Lubricant - Trimethylolpropane Trispelargonate Surfactant - NP 7EO Ratio | 80/20 | Unstable | Unstable | Unstable |
| | 70/30 | Unstable | Unstable | Unstable |
| | 60/40 | Unstable | Unstable | Unstable |

| | | aqueous emulsion[a] | | |
|---|---|---|---|---|
| | Wt./Wt. | 10% | 15% | 20% |
| Lubricant - Tridecyl Stearate Surfactant - NP 7EO Ratio | 80/20 | Unstable | Unstable | Unstable |
| | 70/30 | Unstable | Unstable | Unstable |
| | 60/40 | Unstable | Unstable | Unstable |

[a]Concentration of the textile finish (lubricant/surfactant mixture) in water. Emulsion prepared at 25° C. (Vol./Vol.)
[b]Stable - emulsion stable for 24 hours or longer Micro - stable micro-emulsion formed TABLE 29 a

EMULSION STABILITY DATA

| | | aqueous emulsion[a] | | |
|---|---|---|---|---|
| | Wt./Wt. | 10% | 15% | 20% |
| Lubricant - Coconut Oil Surfactant - NP 7EO Ratio | 80/20 | Unstable[b] | Unstable | Unstable |
| | 70/30 | Unstable | Unstable | Unstable |
| | 60/40 | Unstable | Unstable | Unstable |

| | | aqueous emulsion[a] | | |
|---|---|---|---|---|
| | Wt./Wt. | 10% | 15% | 20% |
| Lubricant - Trimethylolpropane Trispelargonate Surfactant - NP 7OE Ratio | 80/20 | Unstable | Unstable | Unstable |
| | 70/30 | Unstable | Unstable | Unstable |
| | 60/40 | Unstable | Unstable | Unstable |

| | | aqueous emulsion[a] | | |
|---|---|---|---|---|
| | Wt./Wt. | 10% | 15% | 20% |
| Lubricant - Tridecyl Stearate Surfactant - NP 7EO Ratio | 80/20 | Unstable | Unstable | Unstable |
| | 70/30 | Unstable | Unstable | Unstable |
| | 60/40 | Unstable | Unstable | Unstable |

[a]Concentration of the textile finish (lubricant/surfactant mixture) in water. Emulsion prepared at 70° C. (Vol./Vol.)
[b]Stable - emulsion stable for 24 hours or longer Micro - stable micro-emulsion formed

DODECYLPHEONOL 6 EO

The following tests were carried out to show emulsion stability of textile finishes prepared from the dodecylphenol 6 EO product.

TABLE 30

EMULSION STABILITY DATA

| | | aqueous emulsion[a] | | |
|---|---|---|---|---|
| | Wt./Wt. | 10% | 15% | 20% |
| Lubricant - Coconut Oil Surfactant - DDP - 6EO Ratio | 80/20 | Stable[b] | Stable | Stable |
| | 70/30 | Stable | Stable | Stable |
| | 60/40 | Unstable | Unstable | Unstable |

| | | aqueous emulsion[a] | | |
|---|---|---|---|---|
| | Wt./Wt. | 10% | 15% | 20% |
| Lubricant - Trimethylolpropane Trispelargonate Surfactant - DDP 6EO Ratio | 80/20 | Stable | Stable | Stable |
| | 70/30 | Stable | Stable | Stable |
| | 60/40 | Unstable | Unstable | Unstable |

TABLE 30-continued

| EMULSION STABILITY DATA | | | | |
|---|---|---|---|---|
| | Wt./Wt. | 10% | 15% | 20% |
| Lubricant - Tridecyl Stearate Surfactant - DDP 6EO Ratio | 80/20 | Stable | Stable | Stable |
| | 70/30 | Stable | Stable | Stable |
| | 60/40 | Stable | Stable | Stable |

[a]Concentration of the textile finish (lubricant/surfactant mixture) in water. Emulsion prepared at 25° C. (Vol./Vol.)
[b]Stable - emulsion stable for 24 hours or longer Micro - stable micro-emulsion formed

TABLE 31

| EMULSION STABILITY DATA | | | | |
|---|---|---|---|---|
| | | aqueous emulsion[a] | | |
| | Wt./Wt. | 10% | 15% | 20% |
| Lubricant - Coconut Oil Surfactant - DDP 6EO Ratio | 80/20 | Stable[b] | Stable | Stable |
| | 70/30 | Stable | Stable | Stable |
| | 60/40 | Unstable | Unstable | Unstable |
| | | aqueous emulsion[a] | | |
| | Wt./Wt. | 10% | 15% | 20% |
| Lubricant - Trimethylol-propane Trispelargonate Surfactant - DDP 6EO Ratio | 80/20 | Stable | Stable | Stable |
| | 70/30 | Unstable | Unstable | Unstable |
| | 60/40 | Stable | Stable | Stable |
| | | aqueous emulsion[a] | | |
| | Wt./Wt. | 10% | 15% | 20% |
| Lubricant - Tridecyl Stearate Surfactant - DDP 6EO Ratio | 80/20 | Unstable | Stable | Stable |
| | 70/30 | Stable | Unstable | Unstable |
| | 60/40 | Stable | Stable | Unstable |

[a]Concentration of the textile finish (lubricant/surfactant mixture) in water. Emulsion prepared at 70° C. (Vol./Vol.)
[b]Stable - emulsion stable for 24 hours or longer Micro - stable micro-emulsion formed Although the invention has been described in its preferred forms with a certain degree of particularity, it is understood that the present disclosure of the preferred forms has been made only by way of example and that numerous changes may be resorted to without departing from the spirit and scope of the invention.

What is claimed is:

1. A spin finish for synthetic fibers consisting essentially of:

(a) about 50–90% by weight of a thermally stable lubricant selected from the group consisting of (1) esters of fatty acids having about 12 to 18 carbons and saturated aliphatic alcohols having about 8 to 18 carbons; (2) triglycerides of fatty acids having 12 to 18 carbons; (3) esters of a polyhydric alcohol and an alkanoic acid having about 8 to 12 carbons where the polyhydric alcohol has the formula $$(R)_y—C—(CH_2\,OH)_x$$

where x is an integer having values of 3 or 4, R is an alkyl having 1 to 3 carbons, y is an integer having values of 0 or 1 and y=0 when x=4; and (4) esters if dibasic fatty acids having 2 to 18 carbons and saturated aliphatic alcohols having about 4 to 18 carbons; and (b) an emulsification effective surfactant having the formula

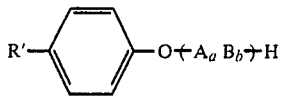

wherein

R′ is an alkyl having 6 to 14 carbons,

A is $$—CH_2—\overset{CH_3}{\overset{|}{C}}HO—,$$

B is $—CH_2CH_2O—$, a and b are integers having values of about 6 to 16 and 4 to 12, respectively.

2. Finish claimed in claim 1 wherein the lubricant is an ester of a fatty acid having 12 to 18 carbons and a saturated aliphatic alcohol having about 8 to 18 carbons.

3. Finish claimed in claim 2 wherein the fatty acid is stearic acid and the alcohol is tridecyl alcohol.

4. Finish claimed in claim 2 wherein the fatty acid is stearic acid and the alcohol is hexadecyl alcohol.

5. Finish claimed in claim 1 wherein the lubricant is a triglyceride of fatty acids.

6. Finish claimed in claim 5 wherein the triglyceride is coconut oil.

7. Finish claimed in claim 1 wherein the lubricant is an ester of a polyhydric alcohol and an alkanoic acid.

8. Finish claimed in claim 7 wherein the polyhydric alcohol is trimethyol propane.

9. Finish claimed in claim 7 wherein the polyhydric alcohol is pentaerythritol.

10. Finish claimed in claim 1 wherein R′ is nonyl.

11. Methods of lubricating synthetic yarns which comprises contacting said synthetic yarns with an aqueous emulsion containing about 5 to about 20% based on the weight of the total solution of a spin finish consisting essentially of:

(a) About 50–90% by weight of a thermally stable lubricant selected from the group consisting of (1) esters of fatty acids having about 12 to 18 carbons and saturated aliphatic alcohols having about 8 to 18 carbons; (2) triglycerides of fatty acids having 12 to 18 carbons; (3) esters of a polyhydric alcohol and an alkanoic acid having about 8 to 12 carbons where the polyhydric alcohol has the formula $$(R)_y—C—(CH_2\,OH)_x$$

wherein x is an integer having values of 3 or 4, R is an alkyl having 1 to 3 carbons, y is an integer having values of 0 or 1 and y=0 when x=4; and (4) esters of dibasic fatty acids having 2 to 18 carbons and saturated aliphatic alcohols having about 4 to 18 carbons;

(b) About 10–50% by weight of an emulsification effective surfactant having the formula

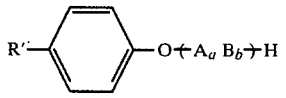

wherein

R′ is an alkyl having 6 to 14 carbons,

A is

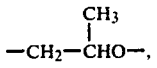

B is $-CH_2CH_2O-$, a and b are integers having values of about 6 to 16 and 4 to 12, respectively.

12. Method claimed in claim 11 wherein the spin finish consists essentially of about 60–80% by weight of lubricant and about 20–40% by weight of surfactant.

13. Method claimed in claim 12 wherein the lubricant is coconut oil and the surfactant is a nonylphenol based ethylene oxide block copolymer containing about 6 to 16 moles of propylene oxide and about 4 to 12 moles of ethylene oxide per mole of nonylphenol.

14. Method claimed in claim 12 wherein the lubricant is tridecyl stearate.

15. Method claimed in claim 12 wherein the lubricant is trimethylolpropane tripelargonate.

16. Method claimed in claim 12 wherein the lubricant is pentaerythritol tetrapelargonate.

17. Finish claimed in claim 1 wherein the lubricant is an ester of a dibasic fatty acid having 2 to 18 carbons and saturated aliphatic alcohols having about 4 to 18 carbons.

18. Finish claimed in claim 17 wherein the dibasic acid is azelaic acid and the alcohol is tridecyl alcohol.

19. Finish claimed in claim 17 wherein the dibasic acid is sebacic acid and the alcohol is tridecyl alcohol.

* * * * *

UNITED STATES PATENT AND TRADEMARK OFFICE

CERTIFICATE OF CORRECTION

PATENT NO. : 4,252,528
DATED : February 24, 1981
INVENTOR(S) : Quintin W. Decker et al.

It is certified that error appears in the above—identified patent and that said Letters Patent is hereby corrected as shown below:

Column 31, subparagraph (b) of claim 1, before "an emulsification effective" insert -- about 10 to 50% by weight of -- .

Signed and Sealed this

*Twenty-ninth* Day of *September 1981*

[SEAL]

*Attest:*

GERALD J. MOSSINGHOFF

*Attesting Officer*

*Commissioner of Patents and Trademarks*